US007008097B1

(12) United States Patent
Hulse

(10) Patent No.: US 7,008,097 B1
(45) Date of Patent: Mar. 7, 2006

(54) ILLUMINATION DEVICE FOR SIMULATING NEON OR FLUORESCENT LIGHTING INCLUDING A WAVEGUIDE AND A SCATTERING CAP

(75) Inventor: George R. Hulse, Cookeville, TN (US)

(73) Assignee: iLight Technologies, Inc., Chicago, IL (US)

( * ) Notice: Subject to any disclaimer, the term of this patent is extended or adjusted under 35 U.S.C. 154(b) by 36 days.

(21) Appl. No.: 10/785,558

(22) Filed: Feb. 24, 2004

Related U.S. Application Data

(60) Provisional application No. 60/449,909, filed on Feb. 25, 2003.

(51) Int. Cl.
*F21V 15/01* (2006.01)

(52) U.S. Cl. ..... 362/546; 362/235; 362/613; 362/605

(58) Field of Classification Search ..... 362/558, 362/235, 612, 613, 605, 565, 812; 40/546, 40/547, 552
See application file for complete search history.

(56) References Cited

U.S. PATENT DOCUMENTS 4,111,520 A 9/1978 Bernal
4,141,058 A * 2/1979 Mizohata et al. ..... 362/558
4,298,869 A 11/1981 Okuno
4,376,946 A 3/1983 Kaminow et al.
4,422,719 A 12/1983 Orcutt
4,597,033 A 6/1986 Meggs et al.
4,607,317 A 8/1986 Lin
4,767,172 A 8/1988 Nichols et al.
4,785,567 A 11/1988 Consiglio
4,891,896 A 1/1990 Boren
4,976,057 A 12/1990 Bianchi
4,996,632 A 2/1991 Aikens
5,057,981 A 10/1991 Bowen et al.
5,151,679 A 9/1992 Dimmick
5,201,020 A 4/1993 Kannabiran
5,219,217 A 6/1993 Aikens
5,301,090 A 4/1994 Hed
5,303,133 A 4/1994 Wagner
5,365,411 A 11/1994 Rycroft et al.
5,375,043 A 12/1994 Tokunaga
5,410,453 A 4/1995 Ruskouski
5,416,679 A 5/1995 Ruskouski et al.
5,418,384 A * 5/1995 Yamana et al. ..... 257/88
5,459,955 A 10/1995 Ruskouski et al.
5,475,786 A 12/1995 Nishiguchi et al.
5,497,440 A 3/1996 Croitoru et al.
5,526,236 A 6/1996 Burnes et al.
5,537,297 A 7/1996 Ghandehari
5,588,236 A 12/1996 Suzuki
5,613,751 A 3/1997 Parker et al.
5,618,096 A 4/1997 Parker et al.
5,640,792 A 6/1997 Smith et al.

(Continued)

*Primary Examiner*—John Anthony Ward
*Assistant Examiner*—Jacob Y. Choi
(74) *Attorney, Agent, or Firm*—Stites & Harbison, PLLC

(57) ABSTRACT

An illumination device includes: an optical waveguide having a first lateral surface for emitting light and a second lateral surface for receiving light; a scattering cap secured to the first lateral surface of and extending substantially the length of the waveguide; and a light source (e.g., a plurality of LEDs spaced a predetermined distance from one another) positioned adjacent to the light-receiving surface of the waveguide. Light entering the waveguide is efficiently transmitted to the scattering cap and is then preferentially scattered so as to exit with a broad elongated light intensity distribution pattern being formed along a lateral surface of the scattering cap.

11 Claims, 3 Drawing Sheets

U.S. PATENT DOCUMENTS 5,694,513 A 12/1997 Okaniwa
5,820,246 A * 10/1998 Helstern ..... 362/84
5,842,297 A 12/1998 Tung
5,876,107 A 3/1999 Parker et al.
5,879,076 A 3/1999 Cross
5,887,968 A 3/1999 Logan
5,913,617 A * 6/1999 Helstern ..... 40/564
5,921,652 A 7/1999 Parker et al.
5,934,792 A 8/1999 Camarota
5,950,340 A 9/1999 Woo
5,964,518 A 10/1999 Shen
5,996,263 A 12/1999 Black
6,023,869 A 2/2000 Durbin
6,042,248 A 3/2000 Hannah et al.
6,076,294 A 6/2000 Durbin
6,079,838 A 6/2000 Parker et al.
6,095,673 A 8/2000 Goto et al.
6,123,442 A 9/2000 Freier et al.
6,146,006 A 11/2000 Cross
6,158,882 A 12/2000 Bischoff, Jr.
6,186,645 B1 2/2001 Camarota
6,193,385 B1 2/2001 Maki et al.
6,204,899 B1 3/2001 Hall
6,283,612 B1 9/2001 Hunter
6,354,714 B1 3/2002 Rhodes
6,361,186 B1 3/2002 Slayden
6,394,623 B1 5/2002 Tsui
6,582,103 B1 6/2003 Popovich et al.
6,592,238 B1 7/2003 Cleaver et al.
6,637,924 B1 * 10/2003 Pelka et al. ..... 362/555
6,676,284 B1 1/2004 Wilson
6,948,840 B1 * 9/2005 Grenda et al. ..... 362/555
6,953,262 B1 * 10/2005 Cleaver et al. ..... 362/219
2003/0095399 A1 * 5/2003 Grenda et al. ..... 362/30
2003/0123245 A1 * 7/2003 Parker et al. ..... 362/31
2003/0198049 A1 * 10/2003 Hulse et al. ..... 362/249
2004/0012956 A1 * 1/2004 Chen ..... 362/240
2005/0169002 A1 * 8/2005 Steen et al. ..... 362/487
2005/0231950 A1 * 10/2005 Cleaver et al. ..... 362/253

* cited by examiner

ILLUMINATION DEVICE FOR SIMULATING NEON OR FLUORESCENT LIGHTING INCLUDING A WAVEGUIDE AND A SCATTERING CAP

CROSS-REFERENCE TO RELATED APPLICATIONS

The present application claims priority to U.S. Provisional Application Ser. No. 60/449,909 filed Feb. 25, 2003, the entire disclosure of which is incorporated herein by reference.

BACKGROUND OF THE INVENTION

The present invention relates to an illumination device for simulating neon lighting using high-intensity, low-voltage light sources, an illumination device ideally adapted for lighting, signage and advertising uses.

Neon lighting, which is produced by the electrical stimulation of the electrons in the low-pressure neon gas-filled glass tube, has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications, including script writing and designs, because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well-established industry, a competitive lighting device must be lightweight and have superior "handleability" characteristics in order to make inroads into the neon lighting market. Neon lighting is recognized as being fragile in nature. Because of the fragility and heavy weight, primarily due to its supporting infrastructure, neon lighting is expensive to package and ship. Moreover, it is extremely awkward to initially handle, install, and/or replace. Any lighting device that can provide those previously enumerated positive characteristics of neon lighting, while minimizing its size, weight, and handleability shortcomings, will provide for a significant advance in the lighting technology.

The more recent introduction of lightweight and breakage resistant point light sources, as exemplified by high-intensity light-emitting diodes, have shown great promise to those interested in illumination devices that may simulate neon lighting and have stimulated much effort in that direction. However, the twin attributes of neon lighting, uniformity and brightness, have proven to be difficult obstacles to overcome as such attempts to simulate neon lighting have largely been stymied by the tradeoffs between light distribution to promote the uniformity and brightness. For example, U.S. Pat. No. 4,976,057 issued Dec. 11, 1990 to Bianchi describes a device that includes a transparent or translucent hollow plastic tubing mounted in juxtaposition to a sheet of material having light transmitting areas that are co-extensive to the tubing. The sheet is backlit by light sources such as LEDs which trace the configuration of the tubing. The tubing can be made into any shape including lettering. While the tubing may be lit by such arrangement, the light transfer efficiencies with such an arrangement is likely to result in a "glowing" tube having insufficient intensity to match that of neon lighting. The use of point light sources such as LEDs may provide intense light that rival or exceed neon lighting, but when arranged in arrays, lack the uniformity needed and unfortunately provide alternate high and low intensity regions in the illuminated surfaces. Attempts to smooth out the light have resulted in lighting that has unacceptably low intensity levels.

In an attempt to address some of the shortcomings of neon, commonly assigned U.S. Pat. No. 6,592,238, which is incorporated in its entirety herein by reference, describes an illumination device comprising a profiled rod of material having waveguide properties that preferentially scatters light entering one lateral surface ("light-receiving surface") so that the resulting light intensity pattern emitted by another lateral surface of the rod ("light-emitting surface") is elongated along the length of the rod. A light source extends along and is positioned adjacent to the light-receiving surface and spaced from the light-emitting surface a distance sufficient to create an elongated light intensity pattern with a major axis along the length of the rod and a minor axis that has a width that covers substantially the entire circumferential width of the light-emitting surface. In a preferred arrangement, the light source is a string of point light sources spaced a distance apart sufficient to permit the mapping of the light emitted by each point light source into the rod so as to create elongated and overlapping light intensity patterns along the light-emitting surface and circumferentially about the surface so that the collective light intensity pattern is perceived as being uniform over the entire light-emitting surface.

One of the essential features of the illumination device described and claimed in U.S. Pat. No. 6,592,238 is the uniformity and intensity of the light emitted by the illumination device. While it is important that the disadvantages of neon lighting be avoided (for example, weight and fragility), an illumination device would have little commercial or practical value if the proper light uniformity and intensity could not be obtained. This objective is achieved primarily through the use of a "leaky" waveguide rod. A "leaky" waveguide is structural member that functions both as an optical waveguide and light scattering member. As a waveguide, it tends to preferentially direct light entering the waveguide, including the light entering a lateral surface thereof, along the axial direction of the waveguide, while as a light scattering member, it urges the light out of an opposite lateral surface of the waveguide. As a result, what is visually perceived is an elongated light pattern being emitted along the light-emitting lateral surface of the waveguide.

As described in U.S. Pat. No. 6,592,238, certain acrylics, polycarbonates, and epoxys have the desired preferential light scattering properties needed to produce a leaky waveguide; for example, one such acrylic material is commercially available from AtoHaas, Philadelphia, Pa. under order number DR66080. These compounds are extremely lightweight and are able to withstand rough shipping and handling. These compounds can be easily molded or extruded into a desired shape for a particular illumination application and thereafter heated and bent to a final desired shape or shapes. However, because of these desirable attributes, these compounds are not inexpensive.

Fluorescent lighting is similar in operation to neon lighting and therefore suffers from some of the same shortcomings as neon lighting. Specifically, fluorescent lighting also is based on the electrical stimulation of a gas in a glass tube. However, the low-pressure mercury vapor that is in the glass tube emits ultraviolet light when ionized. This ultraviolet light contacts a phosphor coating on the inside surface of the glass tube, causing the emission of visible light. Nevertheless, because of its similar construction, fluorescent lighting is also fragile and thus inappropriate for certain applications.

It is therefore an object of the present invention to provide an improved illumination device that serves as an alternative to neon lighting with all the benefits of devices made from known compounds having desired light scattering properties needed to produce a leaky waveguide, but with the additional benefit of reduced expense.

It is a further object of the present invention to provide an improved illumination device that serves as an alternative to fluorescent lighting.

These and other objects and advantages of the present invention will become readily apparent and addressed through a reading of the discussion below and appended drawings.

SUMMARY OF THE INVENTION

The present invention is an illumination device that is an effective simulator of neon and/or fluorescent lighting in that it provides for an essentially uniform light intensity distribution pattern over a lateral, light-emitting surface, but equally important, the illumination device can be produced in a cost effective manner because the amount of light-scattering compound used to produce the device of the present invention is reduced as compared to prior art devices.

To accomplish this, an illumination device made in accordance with the present invention includes: an optical waveguide having a first lateral surface for emitting light and a second lateral surface for receiving light; a scattering cap secured to the first lateral surface of and extending substantially the length of the waveguide; and a light source (e.g., a plurality of LEDs spaced a predetermined distance from one another) positioned adjacent to the light-receiving surface of the waveguide.

The waveguide may be constructed of an acrylic compound or any other highly transmissive material, whereas the scattering cap is constructed from a compound having desired light scattering properties. As such, light entering the waveguide is efficiently transmitted to the scattering cap and is then preferentially scattered so as to exit with a broad elongated light intensity distribution pattern being formed along the surface of the scattering cap.

DETAILED DESCRIPTION OF THE INVENTION

The present invention is an illumination device that is an effective simulator of neon and/or fluorescent lighting in that it provides for an essentially uniform light intensity distribution pattern over a lateral, light-emitting surface, but equally important, the illumination device can be produced in a cost effective manner because the amount of light-scattering compound used to produce the device of the present invention is reduced as compared to prior art devices.

To accomplish this, an illumination device made in accordance with the present invention includes an optical waveguide that is interposed between a light source and a scattering cap. The optical waveguide is capable of efficiently transmitting light entering the waveguide in a preferential direction, preferably through a process known as total internal reflection (TIR). Theoretically, TIR directs light more efficiently than any known reflective surface; for example, directing light using an optical waveguide is more efficient than reflecting light off white walls. Specifically, TIR is the reflection of the total amount of incident light at a boundary, such as the boundary between the side surfaces of the waveguide and air. TIR is possible when the light is in the more dense medium (i.e., the waveguide) and is approaching the less dense medium (i.e., air). Then, assuming the light source is oriented such that the angle of incidence of light at the waveguide-air boundary is greater than a predetermined critical angle, all light will reflected, and there will be no refraction. Accordingly, light entering the waveguide is efficiently directed into the scattering cap, the light scattering properties of this component causing it to uniformly glow over its lateral surface. Importantly, by using the optical waveguide to collect and direct light, the amount of light scattering compound needed to produce the desired result is greatly reduced as compared to prior art devices.

Figure 1:
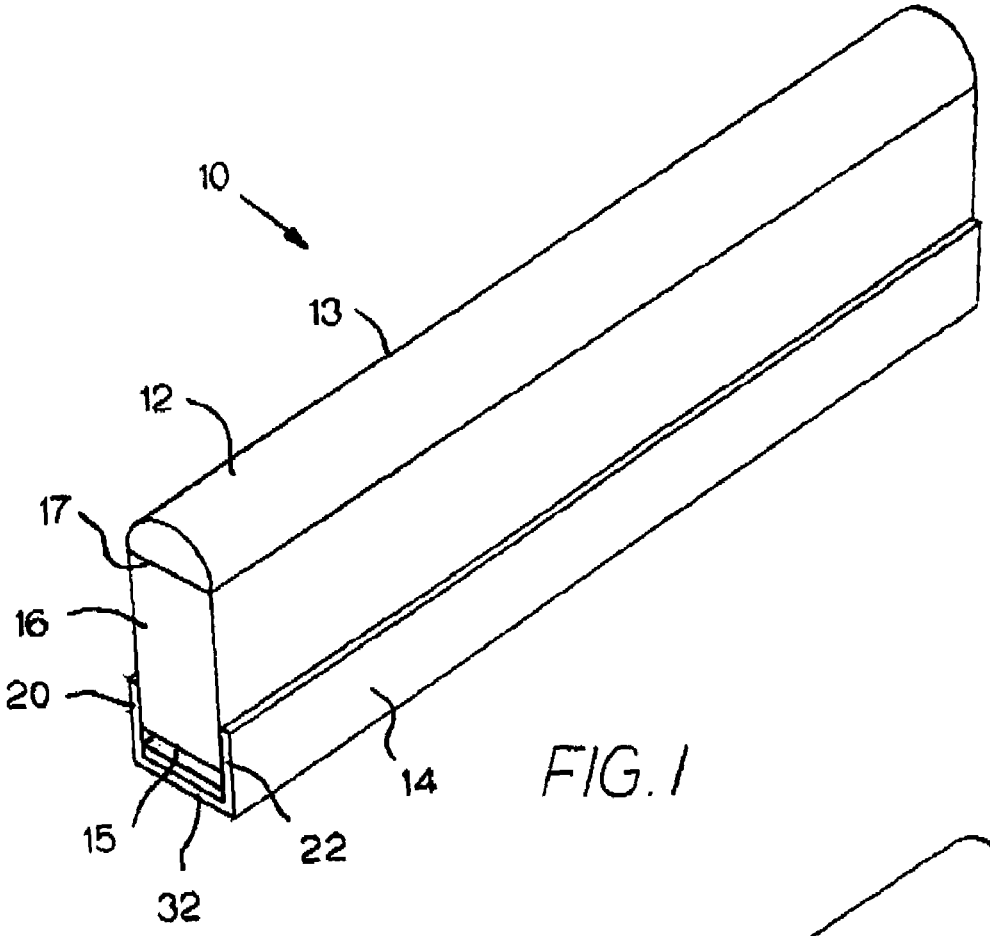
FIG. 1 is a perspective view of an exemplary embodiment of an illumination device made in accordance with the present invention.
Figure 2:
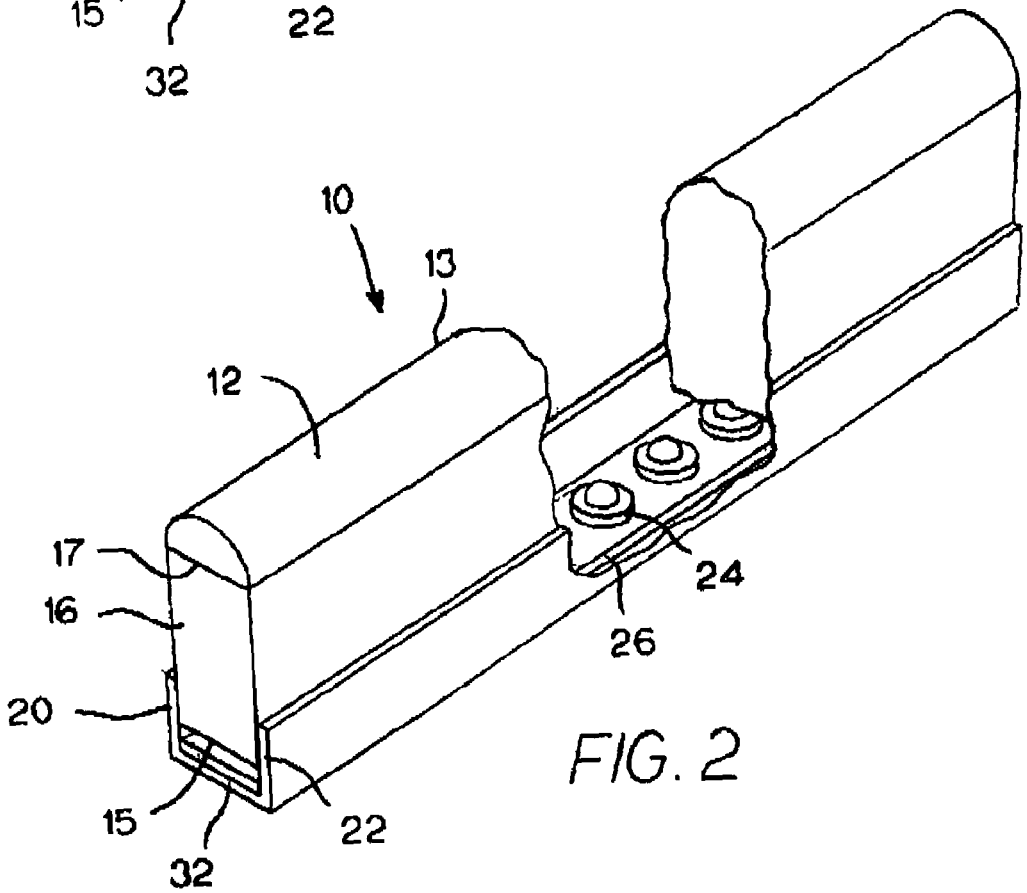
FIG. 2 is a perspective view similar to FIG. 1, but with a portion broken away to show the interior of the illumination device.
Figure 3:
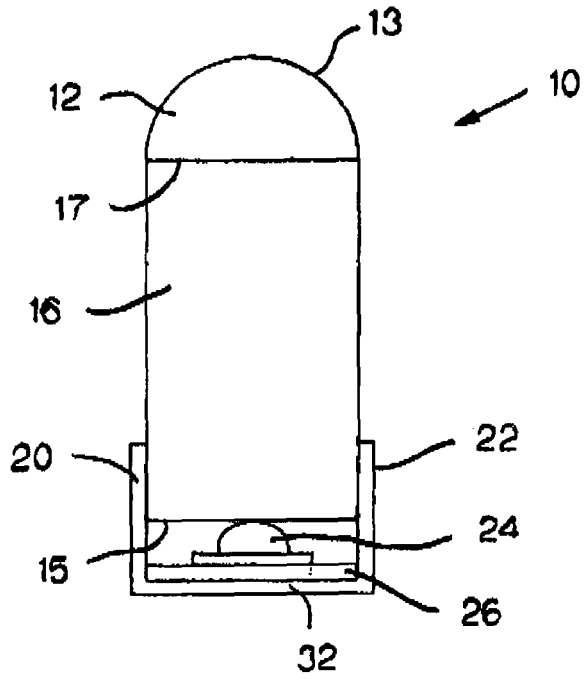
FIG. 3 is an end view of the illumination device of FIGS. 1 and 2.

Referring first to FIGS. 1–3, an exemplary illumination device 10 made in accordance with present invention has three major body components: (a) an optical waveguide (OWG) 16 having a first lateral surface 17 for emitting light and a second lateral surface 15 for receiving light, (b) a scattering cap 12 secured to the first lateral surface 17 of and extending substantially the length of the OWG 16, and (c) a light source 24 positioned adjacent to the second lateral surface 15 of the OWG 16.

As shown, the joined OWG 16 and scattering cap 12 of the illumination device 10 are generally rod-shaped, with the scattering cap 12 having a curved lateral surface 13 in this exemplary embodiment. Although a rod shape is preferred because it best simulates a neon or fluorescent tube, it is contemplated that the OWG 16 and the scattering cap 12 could be molded or extruded into any shape, and that the lateral surface 13 of the scattering cap 12 could take any shape, without departing from the spirit and scope of the present invention.

The OWG 16 may be constructed of an acrylic compound or any other highly transmissive material appropriate for construction of an optical waveguide. Furthermore, it is contemplated that an additional diffusing material could be added to the acrylic compound to smooth the light as is transmitted from the light source 24 to the scattering cap 12; for example, hollow glass spheres, called "micro balloons," could be incorporated into the acrylic compound. The scattering cap 12 is constructed from a compound having the desired light scattering properties such that it functions similar to the "leaky" waveguide described in U.S. Pat. No. 6,592,238. For example, the scattering cap 12 could be constructed from an acrylic material commercially available from AtoHaas, Philadelphia, Pa. under order number DR66080. The curved lateral surface 13 of the scattering cap 12 serves as the light-emitting surface; that is, the light entering the OWG 16 is efficiently transmitted to the scattering cap 12 and is then preferentially scattered so as to exit with a broad elongated light intensity distribution pattern being formed along the surface 13.

As mentioned above, the third essential component of illumination device 10 of the present invention is the light source 24. In the illustrated embodiments, the light source 24 is a plurality of LEDs spaced a predetermined distance from one another. The light source 24 and associated circuit board 26 (along with any other accompanying electrical accessories) are maintained within a housing or channel 14 that extends along the length of the OWG 16 and encloses the light-receiving surface 15 of the OWG 16. Specifically, in the exemplary embodiment illustrated in FIGS. 1–3, the housing 14 preferably comprises a pair of side walls 20, 22 disposed on either side of the OWG 16 connected by a floor 32, thus defining an open-ended channel that engages the side surfaces of the OWG 16. Although the housing 14 is illustrated as being flush against the side surfaces of the OWG 16, it is contemplated that an air gap could be maintained between the housing 14 and the OWG 16 without departing from the spirit and scope of the present invention. Furthermore, it is also possible for the side walls 20, 22 of the housing to extend along substantially the entire side surfaces of the OWG 16, i.e., all the way to the scattering cap 12.

Since it is contemplated that circuit board 26 substantially cover the floor 32, the circuit board 26 is preferably capable of reflecting light. Thus, the circuit board 26 generally serves to collect light not emitted directly into the light-receiving surface 15 of the OWG 16, redirecting that light into the OWG 16. In circumstances where the circuit board 26 does not substantially cover the floor 32, it is preferred that the floor 32 of the housing also be capable of reflecting light.

Similarly, it is also preferred that the internal surfaces of the side walls 20, 22 be capable of reflecting light into the OWG 16; however, because the OWG 16 may be capable of efficiently transmitting light (for example, through total internal reflection), the light-reflecting surfaces of the side walls 20, 22 are not essential to the operation of the illumination device 10. Nevertheless, as will be explained further below, when a foreign object contacts the surface of an optical waveguide, it may cause light to be emitted therefrom, reducing the overall efficiency of light transmission within the optical waveguide. In such cases, by providing reflective surfaces on the side walls 20, 22 of the housing 14, such losses can be minimized.

Also, although not illustrated in FIGS. 1–3, it is contemplated that any gaps or spaces between the light source 24 and the housing 14 may optionally be filled with a potting compound. In this regard, by using a potting compound with an index of refraction essentially identical to that of the OWG 16, Fresnel losses between the OWG 16 and the light source 24 can be minimized.

Finally, although it is not illustrated in the accompanying Figures, it is contemplated that the light source 24 could be inserted into a channel formed in the OWG 16 without departing from the spirit and scope of the present invention. In such an embodiment, the positioning of the light source 24 within the channel could be maintained by filling the channel with potting compound, and thus no separate housing would be required.

As mentioned above, it is known that an optical waveguide is capable of efficiently transmitting light in a preferential direction by a process known as total internal reflection (TIR). It is further recognized that a foreign object, such as dirt or a scratch, on the surface of an optical waveguide may cause light to be emitted at that location, thereby decreasing the efficiency of this process. Accordingly, it is contemplated that the exposed surfaces of the OWG 16 of the illumination device 10 of the present invention be protected from foreign objects to maximize their respective long-term efficiency.

Figure 4:
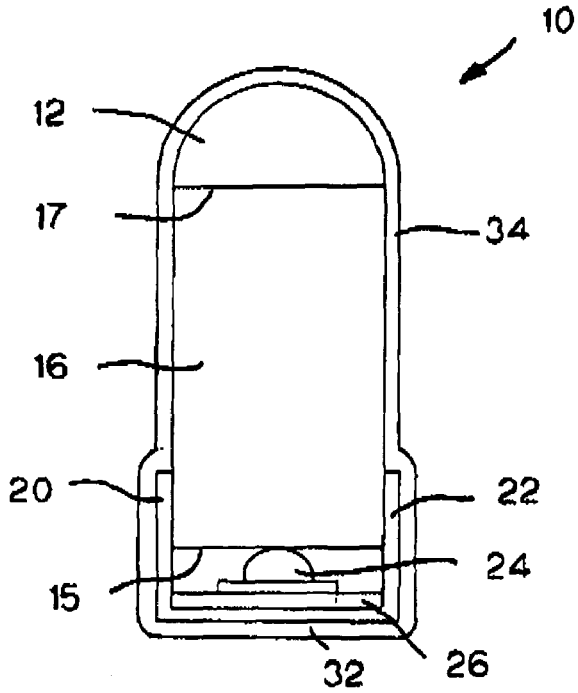
FIG. 4 is an end view of an alternate exemplary illumination device made in accordance with the present invention.

FIG. 4 illustrates an alternate embodiment of an illumination device 10 made in accordance with the present invention that is almost identical to the device 10 illustrated in FIGS. 1–3. However, in this particular embodiments, a protective shield 34 is applied to and encapsulates the device 10, which may be accomplished by spraying or dipping the device in a wear-resistant coating.

Figure 5:
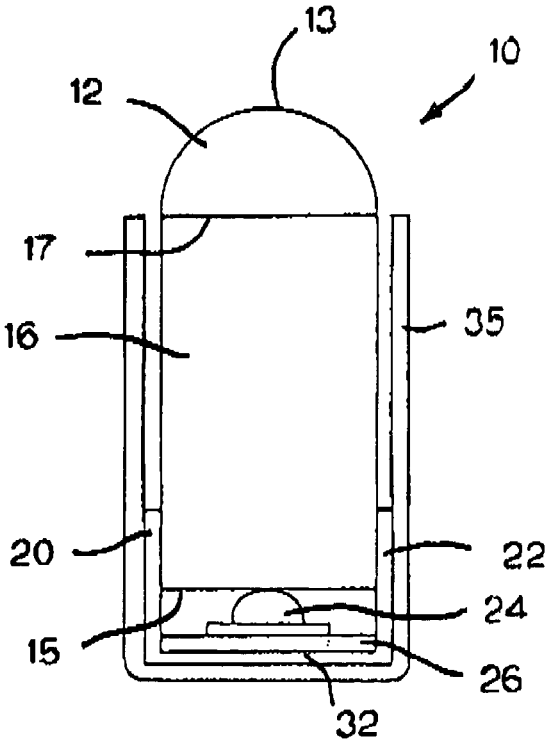
FIG. 5 is an end view of another alternate exemplary illumination device made in accordance with the present invention.

Alternatively, as illustrated in FIG. 5, an illumination device 10 made in accordance with the present invention may be provided with a protective sleeve 35 that encases the entire device 10, except for the exposed light-emitting surface 13 of the scattering cap 12. Such a sleeve 35 may be constructed from acrylic, polycarbonate, sheet metal, or a similar material, and serves to protect the OWG 16 from scratches or other damage. In the embodiment illustrated in FIG. 5, the sleeve 35 is secured to the floor 32 of the housing 14 using an adhesive material, such as silicone, and loosely engages the side surfaces of the OWG 16, such that a small air gap remains between the side surfaces of the OWG 16 and the sleeve 35.

Figure 6:
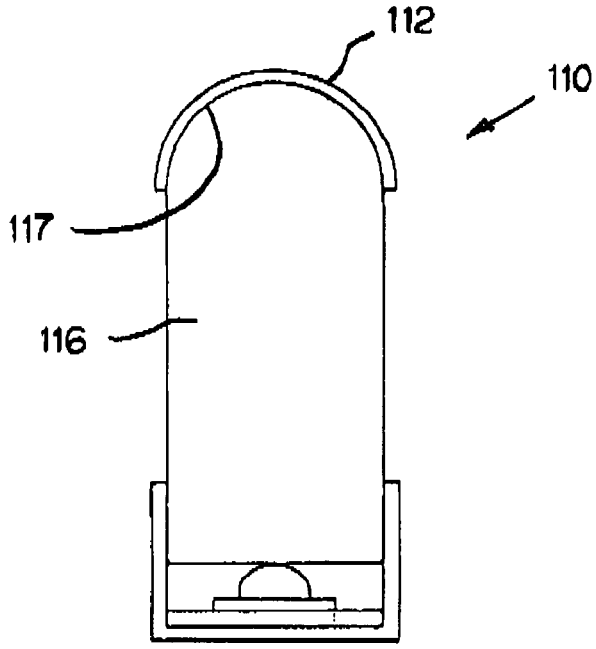
FIG. 6 is an end view of yet another alternate exemplary illumination device made in accordance with the present invention.

Furthermore, it should also be noted that even a very small amount of light scattering compound could be used to form the scattering cap without departing from the spirit and scope of the present invention. For example, FIG. 6 illustrates an alternate exemplary of an illumination device 110 made in accordance with the present invention in which the scattering cap 112 is a thin coating which has been painted or similarly applied to the surface 117 of the optical waveguide 116. In all other aspects, the illumination device 110 is essentially identical to those embodiments described above with references to FIGS. 1–5. Furthermore, although a coating is used to form the scattering cap in the embodiment of FIG. 6, it is also contemplated that bead blasting or chemical etching of the surface 117 of the optical waveguide 116 might also be employed such that the surface 117 of the optical waveguide 116 itself functions as the scattering cap 112.

Figure 7:
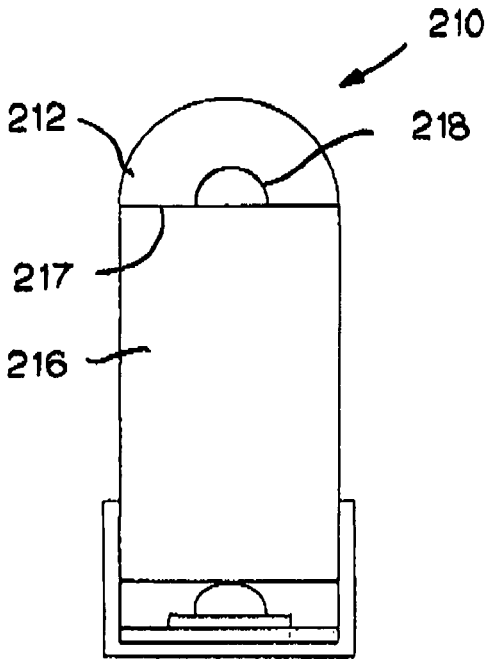
FIG. 7 is an end view of yet another alternate exemplary illumination device made in accordance with the present invention.

Finally, FIG. 7 illustrates an alternate embodiment of an illumination device 210 made in accordance with the present invention that is essentially identical to the device 10 illustrated in FIGS. 1–3, except that the scattering cap 212 of the illumination device 210 has a channel 218 defined therethrough. The channel 218 in the scattering cap 212 is filled with an adhesive material, a so-called "glue trough," which allows the scattering cap 218 to be secured to the OWG 216. The adhesive material used to fill the channel 218 preferably has the same index of refraction as the OWG 216 to minimize Fresnel losses between the adhesive in the channel 218 and the lateral surface 217 of the OWG 216.

In manufacturing an illumination device 10, 110, 210 in accordance with the present invention, it is contemplated that various manufacturing methods could be used. For example, a molding process could be used to produce the optical waveguide and the scattering cap; thereafter, the two components could be joined using a glue joint or a glue trough (e.g., FIG. 7). Alternatively, a double extrusion process could be used. It should be noted that these are but two examples of preferred manufacturing methods, and other techniques and methods could certainly be employed without departing from the spirit and scope of the present invention.

Finally, although not illustrated in the accompanying Figures, as a further refinement, it is contemplated that a preferred illumination device could include a lens system interposed between the elongated light source and the optical waveguide to control the transmission of emitted light into the optical waveguide.

It will be obvious to those skilled in the art that other modifications may be made to the invention as described herein without departing from the spirit and scope of the present invention.

The invention claimed is:

1. An illumination device, comprising:

an optical waveguide with an elongated rod shape and having a predetermined length with a light-receiving surface and a light-emitting surface;

a multiplicity of spaced point light sources positioned adjacent to and arranged in a line extending along the light-receiving surface of said waveguide;

a housing positioned adjacent to said waveguide and enclosing the light-receiving surface of said waveguide;

a scattering cap secured to the light-emitting surface of said waveguide and extending substantially along the length of said waveguide, said scattering cap receiving light transmitted through the waveguide from said point light sources and scattering said light to create a substantially uniform light intensity pattern along a lateral surface of said scattering cap; and a protective shield applied to and encapsulating the waveguide, housing, and scattering cap.

2. The illumination device as recited in claim 1, wherein said protective shield is a wear-resistant coating applied to and encapsulating the waveguide, housing, and scattering cap.

3. The illumination device as recited in claim 1, wherein said point light sources are light-emitting diodes.

4. The illumination device as recited in claim 1, wherein the lateral surface of said scattering cap is curved to simulate a neon or fluorescent tube.

5. The illumination device as recited in claim 1, wherein said housing includes a pair of side walls along side surfaces of said waveguide and defining an open-ended channel that extends substantially the predetermined length of said waveguide.

6. The illumination device as recited in claim 1, wherein said scattering cap is a thin coating applied to the light-emitting surface of said waveguide.

7. An illumination device, comprising:

an optical waveguide with an elongated rod shape and having a predetermined length with a light-receiving surface and a light-emitting surface;

a multiplicity of spaced point light sources positioned adjacent to and arranged in a line extending along the light-receiving surface of said waveguide;

a housing positioned adjacent to said waveguide and enclosing the light-receiving surface of said waveguide;

a scattering cap secured to the light-emitting surface of said waveguide and extending substantially along the length of said waveguide, said scattering cap receiving light transmitted through the waveguide from said point light sources and scattering said light to create a substantially uniform light intensity pattern along a lateral surface of said scattering cap; and a protective sleeve that encases the entire illumination device, except for the lateral surface of the scattering cap.

8. The illumination device as recited in claim 7, wherein said point light sources are light-emitting diodes.

9. The illumination device as recited in claim 7, wherein the lateral surface of said scattering cap is curved to simulate a neon or fluorescent tube.

10. The illumination device as recited in claim 7, wherein said housing includes a pair of side walls along side surfaces of said waveguide and defining an open-ended channel that extends substantially the predetermined length of said waveguide.

11. The illumination device as recited in claim 7, wherein said scattering cap is a thin coating applied to the light-emitting surface of said waveguide.

* * * * *